US007143832B2

(12) United States Patent
Freyer

(10) Patent No.: US 7,143,832 B2
(45) Date of Patent: Dec. 5, 2006

(54) WELL PACKING

(75) Inventor: Jan Freyer, Hafrsfjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 200 days.

(21) Appl. No.: 10/380,100

(22) PCT Filed: Jun. 29, 2001

(86) PCT No.: PCT/NO01/00275

§ 371 (c)(1),
(2), (4) Date: Jun. 16, 2003

(87) PCT Pub. No.: WO02/20941

PCT Pub. Date: Mar. 14, 2002

(65) Prior Publication Data

US 2004/0020662 A1 Feb. 5, 2004

(30) Foreign Application Priority Data

Sep. 8, 2000 (NO) ..... 20004509

(51) Int. Cl.
*E21B 33/12* (2006.01)

(52) U.S. Cl. ..... 166/387; 166/179; 166/187

(58) Field of Classification Search ..... 166/387, 166/179, 187, 294, 295
See application file for complete search history.

(56) References Cited

U.S. PATENT DOCUMENTS

| | | | | |
|---|---|---|---|---|
| 2,849,070 A | | 8/1958 | Maly | |
| 2,945,541 A | | 7/1960 | Maly et al. | |
| 3,099,318 A | | 7/1963 | Miller et al. | |
| 3,385,367 A | | 5/1968 | Kollsman | |
| 3,918,523 A | * | 11/1975 | Stuber | 166/285 |
| 4,137,970 A | | 2/1979 | Laflin et al. | |
| 4,182,677 A | * | 1/1980 | Bocard et al. | 210/680 |
| 4,558,875 A | | 12/1985 | Yamaji | |
| 4,633,950 A | | 1/1987 | Delhommer et al. | |
| 4,635,726 A | * | 1/1987 | Walker | 166/294 |
| 4,862,967 A | | 9/1989 | Harris | |
| 5,180,704 A | * | 1/1993 | Reindl et al. | 502/402 |
| 6,834,725 B1 | * | 12/2004 | Whanger et al. | 166/384 |
| 6,848,505 B1 | * | 2/2005 | Richard et al. | 166/285 |

FOREIGN PATENT DOCUMENTS

| | | |
|---|---|---|
| WO | WO/02059452 | 8/2002 |
| WO | WO/03008756 | 1/2003 |

OTHER PUBLICATIONS

Patent Abstracts of Japan, Publication No. 04-363499, Dec. 12, 1992 (Oyo Corp.).
Patent Abstracts of Japan, Publication No. 2000-064764, Feb. 29, 2000 (Nakayama Nobuo).
Patent Abstracts of Japan, Publication No. 09-161686, Jun. 10, 1997 (Oyo Corp.).
Search report for European application No. EP 06075453.8 dated May 18, 2006.

* cited by examiner

*Primary Examiner*—Kenneth Thompson
(74) *Attorney, Agent, or Firm*—Marlin R. Smith

(57) ABSTRACT

Annular packer (2) arranged on the outside of a production tubing (4) said packer comprises a core (12) comprising elastic polymer swelling by absorption of hydrocarbons. The core (12) may be surrounded by an external mantle of rubber (10), which is permeable to hydrocarbons and may be equipped with a reinforcement (11). The core (12) swells by absorption of hydrocarbons and the packer (2) expands thus in order to seal the annular space (5) between the production tubing (4) and the well wall (6).

25 Claims, 2 Drawing Sheets

WELL PACKING

CROSS REFERENCE TO RELATED APPLICATION

The present application is the U.S. national stage application of International Application PCT/NO01/00275, filed Jun. 29, 2001, which international application was published on Mar. 14, 2002 as International Publication WO 02/20941. The International Application claims priority of Norwegian Patent Application 20004509, filed Sep. 8, 2000.

FIELD OF THE INVENTION

The present invention relates to a method of the nature as stated in the introduction of claim 1 for sealing of an annular space between a well wall in a production well for hydrocarbons and a production tubing, to a peripheral annular packer of the nature as stated in the claims 2–10, comprising an expandable element mainly consisting of rubber material, and to the expanding annular packer for application in said method

BACKGROUND OF THE INVENTION

Completion of oil wells with sand control screens in open hole is a simple and reliable method by to complete a reservoir section. An oil well normally penetrates formations with varying production features, which, in spite of the fact that the sand control screens are closed on the inside, may cause that undesired well fluid by-passes on the outside of these and flow into the section. Therefore, it may be desired to control or shut off sections, which do not produce desired well fluid. This necessitates sealing the external annulus.

Today such seal is achieved by application of inflatable, open-hole packers (external casing packers), which are pressurised by injecting a fluid, which is confined by means of a valve system. As soon as the packer is pressurised, it is unable to follow movements in the face of the formation. Further it is sensitive to changes in temperature and pressure, and there are often considerable problems to achieve a complete seal. Another disadvantage is that the installation of the packer is expensive since well operations requiring complicated equipment are requisited.

From U.S. Pat. No. 4,137,970 a packer is known with an element which by a chemical swelling process result in expansion of the element upon contact with water present in the well at the moment the packer is introduced to the bore hole. The packer element is employed in mining, where water is to be drained from an aquiferous layer above a clay layer. The sealing consists of an expanding packer element. During such a swelling process the packer element will initially expand fast, before it expands slower. This is impractical in an oil well, since the packer will expand before it is placed in the final operating position in the well. This implies that the packer may be put in the wrong position in the well, if it was to be employed in an application like the present invention and cause that the completion string can not be inserted to its planned final position. Application of a medium swelling in water will cause the element to expand upon contact with all regular applied completion fluids or drilling fluids.

From U.S. Pat. No. 4,633,950 polymer particles are known suspended in a special water based carrier fluid, which by circulation pumping shall be injected into a lost circulation zone. The patent does not relate to a packer element, but to a dispersion which shall trickle into porous/fractured rock. The features of such a dispersion implies that it can not be held in place in order to form a solid plug in the annular space of the well. Further, the particles will upon contact with hydrocarbons expand very rapidly due to the large surface area of the small particles. Only minor impurities of remaining oil in the system will therefore result in an undesired early expansion. Moreover, the particles in such a system will not expand at all if they do not contact hydrocarbons before the well is flowing back. This may lead to the polymer being produced with the produced fluids.

Most rubbers have a larger absorption capacity and faster swelling in an aromatic and/or naphtenic hydrocarbon than in an aliphatic hydrocarbon. Most rubbers also have considerably less swelling in water based fluid than in an oil based fluid.

Generally base-oils used in drilling fluids have a higher portion of aliphatic (80–100%) constituents than produced hydrocarbons, normally having 35–80% aliphatic constituents. This implies that most rubbers will have a larger and faster expansion in produced hydrocarbons than in drilling fluids.

PURPOSE OF THE INVENTION

The purpose of the present invention is to enable completion of reservoir sections by complete annular seal, at the same time as the invention allows variations in operational parameters and geological conditions without changing the functionality of the invention. The packer will expand less while the packer is inserted into the well in a drilling fluid or completing fluid than by exposure to hydrocarbons produced from the formation.

This is achieved by the present method for sealing of an annular space between a well wall in a production well for hydrocarbons and a production tubing with a peripheral annular packer comprising an expandable element mainly consisting of rubber material characterised in that in said element a rubber is used which expands by absorbing hydrocarbons, and that the annular packer is inserted mainly by exposing the expanding element to hydrocarbons included in the product of the well.

Further the invention provides an expanding annular packer for use in the method for sealing of the annular space, comprising an expanding element consisting mainly of rubber material which is characterised in that the expanding element is directed to expanding mainly by absorbing hydrocarbons produced by the underground formation.

Further features of the invention are given in the claims 3–10.

SHORT DESCRIPTION OF THE FIGURES

DETAILED DESCRIPTION OF THE INVENTION

Figure 1:
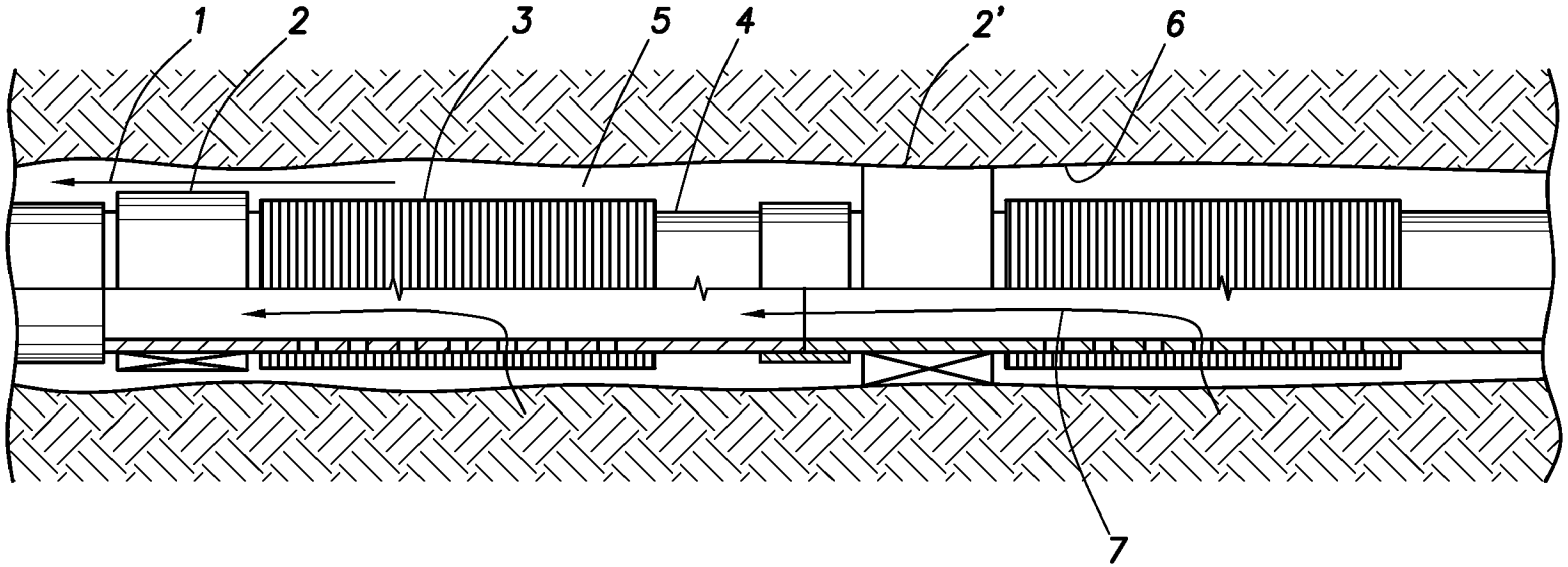
FIG. 1 is a longitudinal section through an area of a production well illustrating the present invention.
Figure 2:
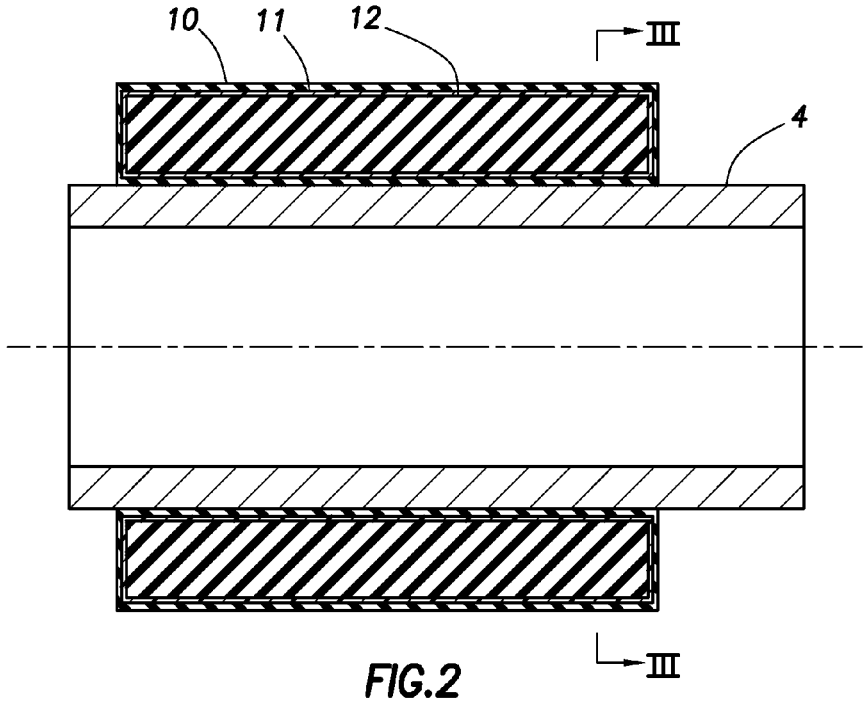
FIG. 2 is a longitudinal section of a production tubing with an annular packer according to the present invention.
Figure 3:
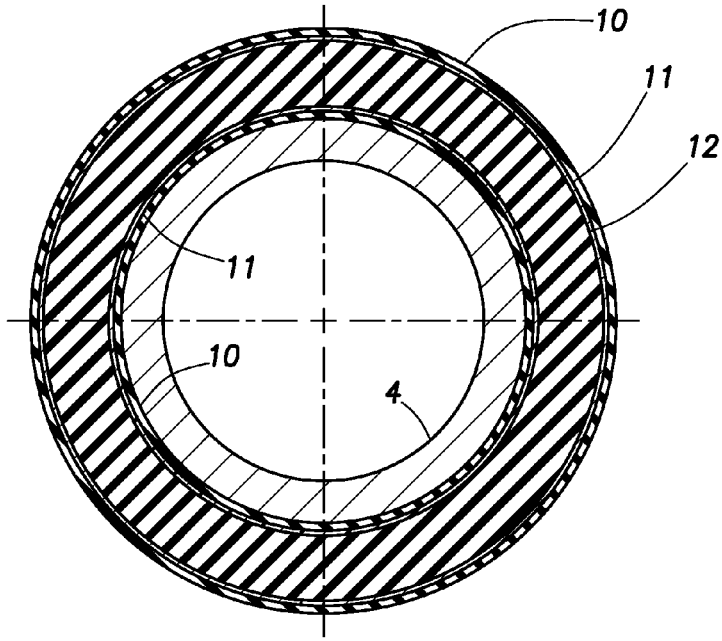
FIG. 3 is a section along the line III—III in FIG. 2.

In the following, the invention is further described. The permanent annular packer 2 for use in hydrocarbon production wells, preferably oil production wells, is placed on the outside of a pipe 4, said packer expands by the core 12 swelling upon exposure for and absorption of hydrocarbons. The packer therefore seals the annular space 5 towards the well wall 6. The production well may be an open-hole well or a well with a casing, which is characterised in that the production tubing 4 is drawn in an open hole or that the production tubing 4 is drawn in a casing (not shown), respectively. Thus the annular space 5 consists of the external surface of the production tubing 4 and the bore hole wall, or the external surface of the production tubing 4 and the internal surface in the casing, respectively.

An oil stream 1 flows past a packer element 2 before the packer element 2 is expanded and sealing towards the well wall 6. A sand control filter 3 is attached to a production tubing 4. A packer element 2' is expanded and sealing towards the well wall 6 so that a well fluid 7 can not bypass the packer element in the annular space 5.

An external, protecting mantle 10 equipped with a reinforcement 11 surrounds a core 12 comprising elastic polymer, said coating works as a permeable membrane. The external mantle 10 comprises a rubber with higher resistance and lower rate of diffusion towards hydrocarbons than the core 12. The packer element, which may consist of a mantle 10, reinforcement 11 and core 12, is placed on the outside of a tube 4.

The packer 2 consists of a core 12 comprising an elastic polymer, e.g. EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber or polynorbornene, said core is swelling in contact with and by absorption of hydrocarbons so that the packer expands. The rubber of the core may also have other materials dissolved or in mechanical mixture, such as fibres of cellulose processed as described in U.S. Pat. No. 4,240,800. Additional options may be rubber in mechanical mixture with polyvinyl chloride, methyl methacrylate, acrylonitrile, ethylacetate or other polymers expanding by contact with oil.

An external, reinforced mantle 10 protects the core towards direct exposure to drilling fluid and hydrocarbons. At the same time the mantle 10 allows migration of hydrocarbons to the core 12 and swelling (and thus expanding of the packer). The external, reinforced mantle 10 comprises rubber, for example acrylonitrile, hydrogenated nitrile, chloroprene, ethylene vinylacetate rubber, silicone, ethylene propylene diene monomer, butyl, chlorosulphonated polyethylene, polyurethane, ACM, BIMS or other types of rubber having less expansion or slower diffusion than the core and a reinforcement 11, preferably fibre reinforcement, e.g. kevlar, said reinforcement reinforces the external mantle 10. An essential feature of the rubber in the mantle 10 is that it has a swelling in drilling fluids, which is slower than the core 12. With "a higher resistance towards hydrocarbons" is here meant that the rubber only to a small degree swells upon exposure to hydrocarbons.

Several elastic polymers have a considerable absorption of hydrocarbons without absorption of water, and the polymers in the present invention are predominantly hydrophobic. By immersion in a hydrocarbonaceous medium, hydrocarbons migrate into and through the external mantle 10 and further into the core 12, which is swelling upon absorption of these.

The present invention provides several benefits compared to state of the art. The packer adjusts continuously to variations in the movements of the formation or washouts of the borehole, which implies that better shutting off/sealing between reservoir sections may be achieved and undesired well fluid can not flow past the packer element in the annular space. There is no need for well operations when installing the packer, which represents cost savings compared to today's methods for installation. The packer has no moving parts and is thus a simple and reliable device. The packer expands faster and more in a produced hydrocarbon, than in a water based or oil based drilling fluid or completion fluid at the same temperature and will thus expand less when the packer is immersed in drilling fluid.

In another embodiment of the present invention, the core 12 is surrounded by an external mantle of rubber, e.g. a nitrile which is not reinforced.

In further another embodiment of the present invention, the core 12 is surrounded by an outer web which may be the reinforcement.

In a further embodiment of the present invention the core 12 is surrounded by an external mantle of rubber, e.g. a nitrile, said mantle in itself does not let hydrocarbons penetrate, but a small part 11 of the core 12 is exposed directly to hydrocarbons through openings in the outer coating.

In an even further embodiment of the present invention the core 12 is not surrounded by an external mantle, but is exposed directly to hydrocarbons. In this aspect, the core 12 has a composition comprising elastic polymer with sufficient features to fulfil the desired functions of the packers.

What is claimed is:

1. A method for sealing an annular space between a well wall and a production tubing in a production well for hydrocarbons, comprising:

applying to the exterior of the production tubing at least one annular packer, the packer including a first elastomer adapted to swell when exposed to hydrocarbons, the packer having disposed externally to the first elastomer a second elastomer having the properties of diffusing hydrocarbons therethrough and having a lower expansion when exposed to hydrocarbons than the first elastomer;

inserting the production tubing into the well; and enabling hydrocarbons to enter the well.

2. The method of claim 1, wherein the second elastomer is adapted to swell when exposed to hydrocarbons.

3. The method of claim 1 further comprising disposing a reinforcement between the first elastomer and the second elastomer on the packer.

4. The method of claim 3 wherein the reinforcement comprises fiber.

5. The method of claim 1 wherein the second elastomer comprises at least one of acrylonitrile, nitrile, hydrogenated nitrile, chloroprene, ethylene vinylacetate, silicone, ethylene propylene diene monomer, butyl, chlorosulphonated polyethylene, polyurethane, ACM, and BIMS.

6. The method of claim 1 wherein the first elastomer comprises at least one of EPDM, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber and polynorbornen.

7. The method of claim 1 wherein the first elastomer includes therein at least one of processed fibers of cellulose and processed fibers of rubber, the processed fibers mechanically mixed with polymers expandable by contact with oil, the polymers comprising at least one of polyvinyl chloride, methyl methacrylate, acrylonitrile and ethylacetate.

8. A packer for sealing an annular space between a well wall and a production tubing in a production well for hydrocarbons, comprising:

a first elastomer adapted to swell when exposed to hydrocarbons, the first elastomer formed generally in the shape of an annular cylinder applicable to the external surface of the production tubing; and a second, swellable elastomer applied to substantially the entire external surface of the first elastomer, the second elastomer having the properties of diffusing hydrocarbons therethrough and having a lower expansion when exposed to hydrocarbons than the first elastomer.

9. The packer of claim 8 further comprising a reinforcement disposed between the first elastomer and the second elastomer on the packer.

10. The packer of claim 9 wherein the reinforcement comprises fiber.

11. The packer of claim 8 wherein the second elastomer comprises at least one of acrylonitrile, nitrile, hydrogenated nitrile, chloroprene, ethylene vinylacetate, silicone, ethylene propylene diene monomer, butyl, chlorosulphonated polyethylene, polyurethane, ACM, and BIMS.

12. The packer of claim 8 wherein the first elastomer comprises at least one of EPDM, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber and polynorbomen.

13. The packer of claim 8 wherein the first elastomer includes therein at least one of processed fibers of cellulose and processed fibers of rubber, the processed fibers mechanically mixed with polymers expandable by contact with oil, the polymers comprising at least one of polyvinyl chloride, methyl methacrylate, acrylonitrile and ethylacetate.

14. A packer for sealing an annular space between a well wall and a production tubing in a production well for hydrocarbons, comprising:

a first elastomer adapted to swell when exposed to hydrocarbons, the first elastomer formed generally in the shape of an annular cylinder applicable to the external surface of the production tubing; and a second swellable elastomer applied to substantially the entire external surface of the first elastomer, the second elastomer having perforations therein to enable diffusing hydrocarbons, and having a lower expansion when exposed to hydrocarbons than the first elastomer.

15. The packer of claim 14 further comprising a reinforcement disposed between the first elastomer and the second elastomer on the packer.

16. The packer of claim 15 wherein the reinforcement comprises fiber.

17. The packer of claim 14 wherein the second elastomer comprises at least one of acrylonitrile, nitrile, hydrogenated nitrile, chloroprene, ethylene vinylacetate, silicone, ethylene propylene diene monomer, butyl, chlorosulphonated polyethylene, polyurethane, ACM, and BIMS.

18. The packer of claim 14 wherein the first elastomer comprises at least one of EPDM, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber and polynorbornen.

19. The packer of claim 14 wherein the first elastomer includes therein at least one of processed fibers of cellulose and processed fibers of rubber, the processed fibers mechanically mixed with polymers expandable by contact with oil, the polymers comprising at least one of polyvinyl chloride, methyl methacrylate, acrylonitrile and ethylacetate.

20. A packer for sealing an annular space between a well wall and a production tubing in a production well for hydrocarbons, comprising:

an elastomer adapted to swell when exposed to hydrocarbons, the elastomer formed generally in the shape of an annular cylinder applicable to the external surface of the production tubing; and an outer layer applied to substantially the entire external surface of the first elastomer, the outer layer being formed from a material having slower diffusion to hydrocarbons than the elastomer.

21. The packer of claim 20 further comprising a reinforcement disposed between the elastomer and outer layer on the packer.

22. The packer of claim 21 wherein the reinforcement comprises fiber.

23. The packer of claim 20 wherein the outer layer comprises at least one of acrylonitrile, nitrile, hydrogenated nitrile, chloroprene, ethylene vinylacetate, silicone, ethylene propylene diene monomer, butyl, chlorosulphonated polyethylene, polyurethane, ACM, and BIMS.

24. The packer of claim 20 wherein the elastomer comprises at least one of EPDM, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber and polynorbomen.

25. The packer of claim 20 wherein the elastomer includes therein at least one of processed fibers of cellulose and processed fibers of rubber, the processed fibers mechanically mixed with polymers expandable by contact with oil, the polymers comprising at least one of polyvinyl chloride, methyl methacrylate, acrylonitrile and ethylacetate.

* * * * *